US011053760B2

(12) United States Patent
Baker et al.

(10) Patent No.: US 11,053,760 B2
(45) Date of Patent: Jul. 6, 2021

(54) SETTING TOOL

(71) Applicant: Kingdom Downhole Tools, LLC, Granbury, TX (US)

(72) Inventors: Trea Baker, Granbury, TX (US); Justice Baker, Granbury, TX (US)

(73) Assignee: Kingdom Downhole Tools, LLC, Granbury, TX (US)

( * ) Notice: Subject to any disclaimer, the term of this patent is extended or adjusted under 35 U.S.C. 154(b) by 23 days.

(21) Appl. No.: 16/696,832

(22) Filed: Nov. 26, 2019

(65) Prior Publication Data

US 2020/0095838 A1 Mar. 26, 2020

Related U.S. Application Data

(63) Continuation-in-part of application No. PCT/US2019/037125, filed on Jun. 13, 2019.

(60) Provisional application No. 62/697,590, filed on Jul. 13, 2018.

(51) Int. Cl.
*E21B 23/06* (2006.01)

(52) U.S. Cl.
CPC ..... *E21B 23/065* (2013.01)

(58) Field of Classification Search
CPC ..... E21B 23/065
See application file for complete search history.

(56) References Cited

U.S. PATENT DOCUMENTS 2,308,004 A 1/1943 Hart
2,578,900 A 12/1951 Ragan
2,618,343 A 11/1952 Conrad
2,637,402 A 5/1953 Baker
2,640,547 A 6/1953 Baker
2,695,064 A 11/1954 Ragan
2,701,614 A 2/1955 Ragan
2,713,907 A 7/1955 Kline
2,713,910 A 7/1955 Baker
(Continued)

FOREIGN PATENT DOCUMENTS

WO 2016161379 A1 10/2016

OTHER PUBLICATIONS

International Search Report and the Written Opinion of the International Searching Authority, or the Declaration dated Sep. 19, 2019 in connection with International Patent Application No. PCT/US2019/037125, 22 pages.

(Continued)

*Primary Examiner* — D. Andrews

(57) ABSTRACT

A gas operated setting tool comprising a piston rod and an outer tool assembly having a hollow interior within which the piston rod is disposed coaxially. The outer tool assembly comprises a top cap connected to the cylinder's upper end and a bottom connector connected to the cylinder's lower end. The piston rod comprises an upper section to which a firing head attaches and a lower section to which a setting adapter attaches. The piston section's exterior surface fits within and is sealed against the cylinder's interior surface. The piston rod has a hollow power charge chamber and port holes that open into the bottom connector's upper surface. A shear ring engages a counterpart surface feature to prevents axial movement of the outer tool assembly relative to the piston rod until the power charge has fired and sheared the shear ring.

14 Claims, 3 Drawing Sheets

(56) References Cited

U.S. PATENT DOCUMENTS

| | | | |
|---|---|---|---|
| 2,799,343 | A | 7/1957 | Conrad |
| 2,807,325 | A | 9/1957 | Webb |
| 2,978,028 | A | 4/1961 | Webb |
| 3,024,843 | A | 3/1962 | Hanes |
| 3,029,872 | A | 4/1962 | Hanes |
| 3,029,873 | A | 4/1962 | Hanes |
| 3,055,430 | A | 9/1962 | Campbell |
| 3,062,295 | A | 11/1962 | Hanes |
| 3,091,293 | A | 5/1963 | Fry |
| 3,112,794 | A | 12/1963 | Chenoweth |
| 3,125,162 | A | 3/1964 | Briggs, Jr. |
| 3,138,207 | A | 6/1964 | Peppers |
| 3,160,209 | A | 12/1964 | Bonner |
| 3,186,485 | A | 6/1965 | Owen |
| 3,244,232 | A | 4/1966 | Myers |
| 3,255,822 | A | 6/1966 | Conrad |
| 3,266,575 | A | 8/1966 | Owen |
| 3,298,437 | A | 1/1967 | Conrad |
| 3,303,884 | A | 2/1967 | Medford, Jr. |
| 4,311,195 | A | 1/1982 | Mullins, II |
| 5,024,270 | A | 6/1991 | Bostick |
| 5,203,414 | A | 4/1993 | Hromas et al. |
| 5,316,087 | A | 5/1994 | Manke et al. |
| 6,702,009 | B1 | 3/2004 | Drury et al. |
| 6,874,545 | B1 | 4/2005 | Larimer et al. |
| 6,899,181 | B2 | 5/2005 | Simpson et al. |
| 7,017,672 | B2 | 3/2006 | Owen, Sr. |
| 7,036,602 | B2 | 5/2006 | Turley et al. |
| 7,077,212 | B2 | 7/2006 | Roesner et al. |
| 7,303,020 | B2 | 12/2007 | Bishop et al. |
| 8,132,627 | B2 | 3/2012 | Braddick |
| 8,887,818 | B1 | 11/2014 | Carr et al. |
| 9,074,439 | B2 | 7/2015 | VanLue |
| 9,453,382 | B2 | 9/2016 | Carr et al. |
| 9,810,035 | B1 * | 11/2017 | Carr ..... E21B 23/065 |
| 10,107,054 | B2 | 10/2018 | Drury et al. |
| 10,443,331 | B1 | 10/2019 | Andres et al. |
| 2004/0055755 | A1 | 3/2004 | Roesner et al. |
| 2004/0216868 | A1 | 11/2004 | Owen, Sr. |
| 2005/0183864 | A1 | 8/2005 | Trinder et al. |
| 2007/0107913 | A1 | 11/2007 | Arnold et al. |
| 2009/0242213 | A1 | 10/2009 | Braddick |
| 2013/0140041 | A1 | 6/2013 | Allen et al. |
| 2013/0299160 | A1 | 11/2013 | Lott |
| 2015/0285019 | A1 | 10/2015 | Wood et al. |
| 2015/0308236 | A1 | 10/2015 | LaGrange et al. |
| 2016/0115753 | A1 | 4/2016 | Frazier et al. |
| 2017/0166161 | A1 | 6/2017 | Englbrecht et al. |
| 2018/0080298 | A1 | 3/2018 | Covalt |
| 2019/0106956 | A1 * | 4/2019 | Wells ..... E21B 33/12 |
| 2020/0018132 | A1 | 1/2020 | Ham |
| 2020/0080394 | A1 | 3/2020 | Slup et al. |

OTHER PUBLICATIONS

Hunting, "T-Set Setting Tool Product Catalog", 2015, 86 pages.
Braddick, Britt O., "Downhole Tabular Expansion Tool and Method", U.S. Appl. No. 12/482,538, filed Jun. 11, 2009, 224 pages.
Covalt, Johnny, "Opposing Piston Setting Tool", U.S. Appl. No. 15/563,798, filed Oct. 2, 2017, 206 pages.
Diamondback Industries, Inc., Catalog, 2012, 118 pages.
U.S. Department of Transportation, "Classification of Explosives", Pipeline and Hazardous Materials Safety Administration, Tracking No. 2013051164, Aug. 23, 2013, 7 pages.
Englbrecht, Karl, "Pyrotechnical Actuator for Vehicle Safety System, Actuator Assembly, Vehicle Safety System Comprising Such Actuator as Well as Actuating Method", U.S. Appl. No. 15/372,542, filed Dec. 8, 2016, 130 pages.
Owen Sr., Harrold D., "Self-Set Bridge Plug", U.S. Appl. No. 10/833,462, filed Apr. 28, 2004, 107 pages.
Roesner, Thomas, "Method of Hydraulically Actuating and Mechanically Activating a Downhole Mechanical Apparatus", U.S. Appl. No. 10/251,635, filed Sep. 20, 2002, 466 pages.
PCT Search Report dated Aug. 22, 2016 corresponding to PCT International Application No. PCT/US2016/025732 filed Apr. 1, 2016, 5 pages.
Certified Priority Document of U.S. Appl. No. 62/142,083, filed Apr. 2, 2015, 23 pages.

* cited by examiner

Wellbore fluid flow during deployment

Wellbore fluid flow during stroke

SETTING TOOL

CROSS-REFERENCE TO RELATED APPLICATIONS AND CLAIM OF PRIORITY

This application is a continuation-in-part of International Patent Application No. PCT/US2019/37125 filed on Jun. 13, 2019, which claims the benefit of U.S. Provisional Patent Application No. 62/697,590 filed on Jul. 13, 2018. The disclosures of the above-identified patent documents are incorporated herein by reference.

TECHNICAL FIELD

The present disclosure relates to setting tools that can be used in an oil or gas well to secure a zone isolation device in the wellbore.

BACKGROUND

Setting tools for setting a zone isolation plug or packer within a borehole typically have a design limiting the types of securing mechanisms that may be employed to secure or retain the setting tool in a compact or unstroked configuration within which the setting tool is run into the borehole, before activation. In particular, setting tool designs generally are not suited for use with one-time or disposable securing mechanisms.

In addition, the design of commercially available setting tools frequently limits the materials suitable for components, such that readily available items such as borehole tubing cannot be employed as part of the setting tool due to design and/or geometry. Instead, specially machined components are required, increasing the cost and production time in general and, in particular, increasing the cost beyond a level practical for a disposable setting tool.

Still further, use of a shear screw to retain the setting tool in the unstroked configuration during hook-up and run-in requires that rotational forces during those processes be sufficiently small to avoid inadvertent shearing of the shear screw.

SUMMARY

A gas operated setting tool in accordance with an embodiment comprises a cylinder, made from tubing, a bottom connector, a piston rod, and a top cap.

One exemplary embodiment includes a gas operated setting tool having a mandrel and an outer tool assembly. The outer tool assembly has a hollow interior and the mandrel is disposed within the hollow interior of the outer tool assembly. The outer tool assembly includes a top cap having an interior surface, a cylinder having an upper end, a lower end, and an interior surface, and a bottom connecter having an upper surface and an interior surface. The top cap connects to the upper end of the cylinder and the bottom connector connects to the lower end of the cylinder. The mandrel includes an upper section having an exterior surface, a piston section having an exterior surface, and a lower section having an exterior surface. The upper section of the mandrel includes a firing head attachment and the lower section of the mandrel is configured to connect to a setting adapter. The exterior surface of the piston section fits within and is sealed against said the interior surface of the cylinder. The upper section of the mandrel has a hollow power charge chamber configured to receive a power charge and the piston section has gas ports that extend from a bottom of the power charge chamber directly onto the bottom connector. In some implementations, a shear ring between the exterior surface of the mandrel and the interior surface of the top cap prevents axial movement of the outer tool assembly relative to the piston rod until the power charge has fired and sheared the shear ring to stroke the setting tool.

Another exemplary embodiment includes a gas operated setting tool having a piston rod and an outer tool assembly. The outer tool assembly has a hollow interior and the piston rod is disposed coaxially within the outer tool assembly's hollow interior. The outer tool assembly includes a top cap having an interior surface, a cylinder having an upper end, a lower end, and an interior surface, and a bottom connecter having an upper surface and an interior surface. The top cap connects to the cylinder's upper end and the bottom connector connects to the cylinder's lower end. The piston rod comprises an upper section having an exterior surface, a piston section having an exterior surface, and a lower section having an exterior surface. The piston rod's upper section comprises a firing head attachment and the piston rod's lower section is configured to connect to a setting adapter. The piston section's exterior surface fits within and is sealed against the cylinder's interior surface. The piston rod's upper section has a hollow power charge chamber configured to receive a power charge and the piston section has port holes that open into the power charge chamber at one end and that open directly onto the bottom connector's upper surface at the other end. The top cap's interior surface engages the piston rod's exterior surface to prevent axial movement of the outer tool assembly relative to the piston rod until the power charge is fired to stroke the gas operated setting tool. In some implementations, the top cap's interior surface comprises a shear ring that engages a surface feature on the piston rod's exterior surface to prevent the axial movement of the outer tool assembly relative to the piston rod until the power charge is fired. In some implementations, the piston rod's exterior surface comprises a shear ring that engages a surface feature on the top cap's interior surface to prevent the axial movement of the outer tool assembly relative to the piston rod until the power charge is fired. In some implementations, a center portion of an end of the power charge chamber between the ports holes extends into the power charge chamber to cause pressurized gasses in the power charge chamber to more efficiently flow to the port holes.

DETAILED DESCRIPTION

Figure 1:
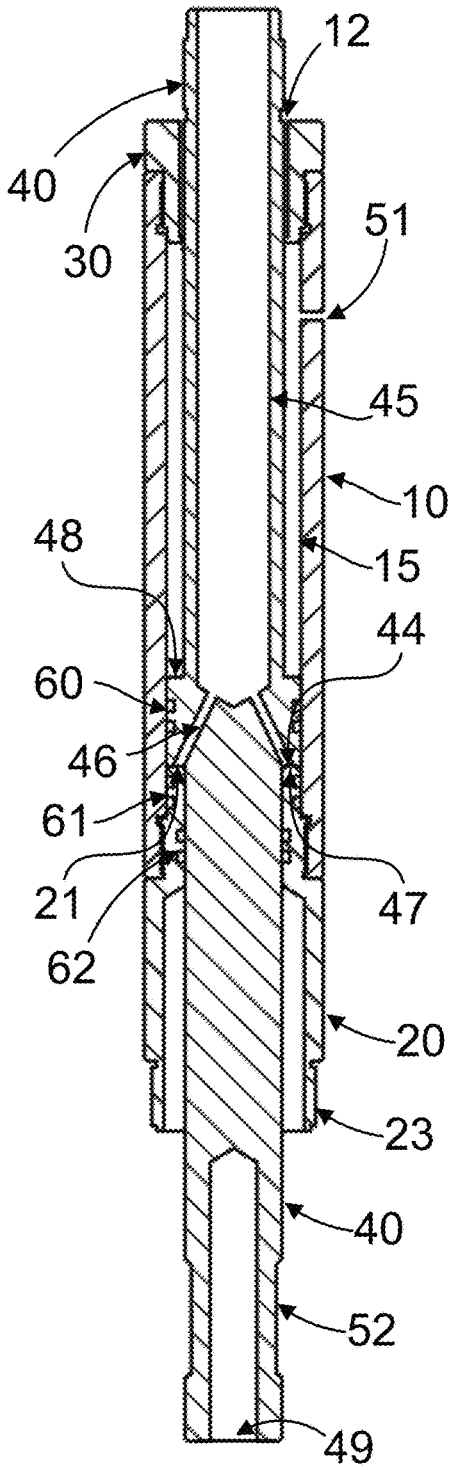
FIG. 1 shows a cross section of a gas operated setting tool in the unstroked position in accordance with an embodiment of the present disclosure.

A gas operated setting tool in accordance with an embodiment comprises a cylinder 10, a bottom connector 20, a piston rod 40, and a top cap 30. The cylinder 10 is sometimes called a barrel or barrel piston, and the piston rod 40 is sometimes called a mandrel.

In the various embodiments depicted in FIGS. 1-4, the outer tool assembly (OTA) of the setting tool comprises the top cap 30, the cylinder 10, and the bottom connector 20. The cylinder 10 has a top end and a bottom end. The cylinder's top end connects to the top cap 30 and the cylinder's bottom end connects to the bottom connector 20. The top cap 30 and the bottom connector 20 are secured to the cylinder 10 (e.g., by threaded engagement) so that the top cap 30 and the cylinder 10 move in conjunction with movement of the bottom connector 20. When the setting tool strokes, the OTA moves axially relative to the piston rod 40 from the unstroked position shown (for example) in FIG. 1 to the stroked position shown in FIG. 3. A seal 60 (e.g., O-rings) is provided between the inner surface of the cylinder 10 and the outer surface of the piston rod 40, between the upper projecting shoulder 48 and the lower shoulder 47. A seal 61 is provided between the outer surface of the bottom connector 20 and the inner surface of the cylinder 10, above the threaded connection of the bottom connector 20 to the cylinder 10.

Figure 2:
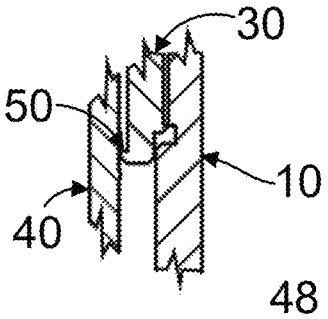
FIG. 2 shows an inset showing a cross section of a gas operated setting tool's shear ring in the unstroked position in accordance with an embodiment of the present disclosure.
Figure 3:
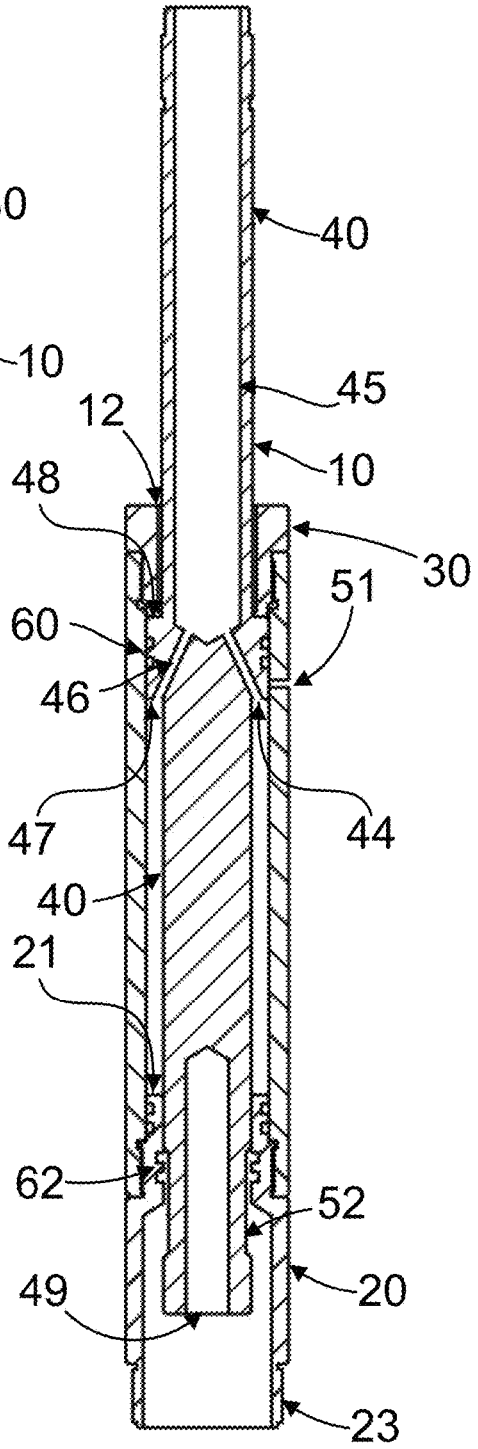
FIG. 3 shows a cross section of a gas operated setting tool in the stroked position in accordance with an embodiment of the present disclosure.
Figure 4:
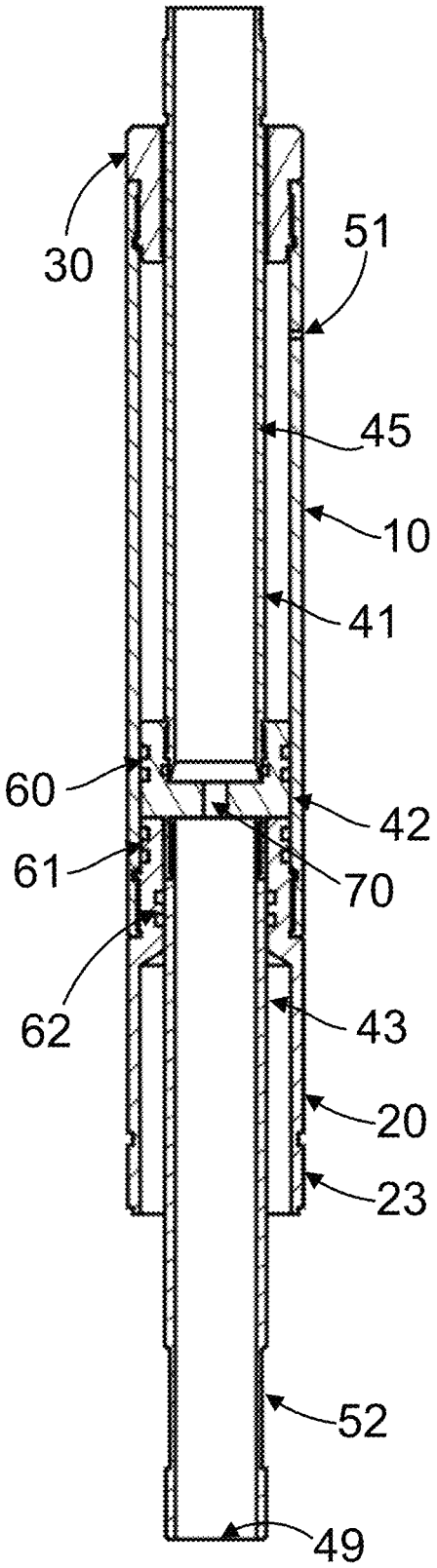
FIG. 4 shows a cross section of a gas operated setting tool in the unstroked position in accordance with an embodiment of the present disclosure.

In the embodiment(s) of FIGS. 1-3, the piston rod 40, or mandrel, has a unitary, machined construction. In the embodiment of FIG. 4, the piston rod 40, or mandrel, is modular and has a piston section 42, an upper section 41, and a lower section 43. In general, the unitary piston rod for the embodiment(s) of FIGS. 1-3 will be described in detail below, with additional description provided to identify corresponding structures for the modular piston rod 40 of FIG. 4.

A firing head (not shown) can be attached to the piston rod's upper end. A setting adapter (also not shown) can be attached to the piston rod's lower end. The structure, attachment, and use of both the firing head and the setting adapter (which are commercially available) is understood by those in the art and, for clarity and conciseness, will not be described in detail in this disclosure. Even if a setting tool designed as depicted in FIGS. 1-5 is disposable, the firing head and setting adapter may be reused.

Within the piston rod 40 of all of the exemplary embodiments, a hollow interior space called the power charge chamber 45 that receives and houses the power charge which, when fired, generates gas pressure needed to stroke the setting tool. The design and manufacture of suitable power charges (which are commercially available) and their operation within setting tools of the type described herein is understood by those in the art and, for clarity and conciseness, will not be described further.

As shown in the drawings, the annular top cap 30 preferably has an interior surface that engages the exterior surface of the upper end of the piston rod 40. As shown in the detail of FIG. 2, the engagement between the two surfaces—that is, the interior surface of the top cap 30 and the exterior surface of the piston rod's upper end—comprises a circumferential shear ring 50 on one of the two surfaces and a counterpart surface feature that comprises one of another shear ring, a circumferential groove, ledge, or ridge on the other surface. The shear ring 50 on the one surface engages the surface feature on the other surface, so that the shear ring 50 and the corresponding surface feature collectively form a securing mechanism to inhibit the top cap 30 (and components secured to top cap 30) from moving axially relative to piston rod 40, thus preventing the setting tool from inadvertently stroking while traveling down hole. For some embodiments, the piston rod's upper end has the shear ring 50. For other embodiments, the shear ring 50 could be part of the top cap's interior surface. The shear ring 50 can be integral to the piston rod 40 by, for example, being machined into the piston rod's upper end. Incorporating the shear ring 50 into the mandrel (or piston rod) 40 rather than the top cap 30 streamlines manufacturing. The shear ring 50 also provides an operator with a more efficient way to attach the setting tool in the field. When the setting tool is activated, the shear ring 50 will shear, rendering the tool inoperable after a single run. The setting tool is therefore disposable. However, when the shear ring 50 is incorporated into the top cap 30 instead of the piston rod 40, the piston rod 40 may possibly be reused, depending on damage to the corresponding surface feature during shearing of the shear ring 50. Likewise, when the shear ring 50 is incorporated into the piston rod 40 instead of the top cap 30, the top cap 30 may possibly be reused, depending on damage to the corresponding surface feature during shearing of the shear ring 50. When shear rings incorporated into both the top cap 30 and the piston rod 40, both shear rings will shear and neither part will be reusable. However, the shear ring 50 may be implemented as a snap ring fitting into a surface groove for the piston rod 40, the top cap 30, or both, in which case only the snap ring would need to be replaced.

Figure 5:
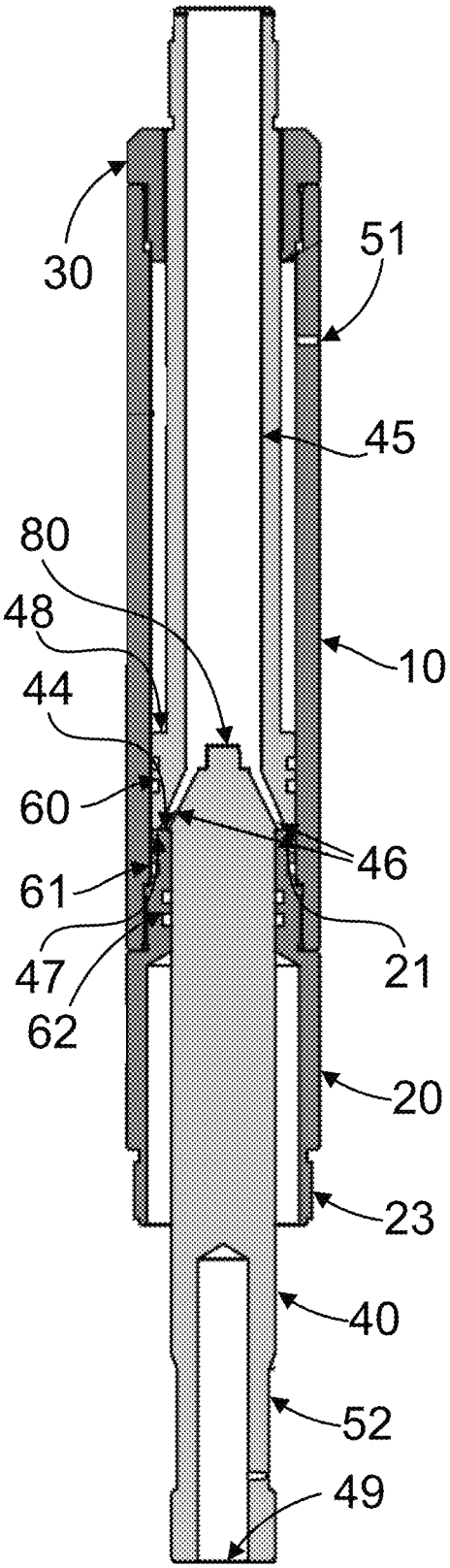
FIG. 5 shows a cross section of a gas operated setting tool in the unstroked position in accordance with an embodiment of the present disclosure.

Before the power charge within the setting tool is fired, a lower shoulder 47 around the piston rod 40 (or the bottom of the piston rod's piston section 42 for the embodiment of FIG. 4) rests against an end surface of the bottom connector 20. The piston rod 40 has one or more port holes (e.g., port holes 44 at the end of flow paths 46 in FIGS. 1, 3 and 5, or the port hole at the end of flow path 70 in FIG. 4) that penetrate through a portion of the piston rod. The top(s) of flow path(s) for the port hole(s) open into the power charge chamber 45. The bottom of the flow path(s) for the port holes are against the bottom connector 20 when the setting tool is in the unstroked configuration, so that the power charge chamber 45 is in fluid communication with a surface on the bottom connector 20. In the example of FIGS. 1, 3 and 5, the power charge chamber 45 is formed in an upper section of the unitary piston rod 40, and the flow paths 46 for the port holes 44 extend from the power charge chamber 45 to the lower shoulder 47 projecting from the piston rod 40. In the example of FIG. 4, the power charge chamber 45 is formed within the upper section 41 of the modular piston rod 40, terminated by the piston section 42, and the flow path 70 extends axially through the piston section 42.

When the power charge fires, gas flows from the power charge chamber 45 through the flow path(s) in the piston rod connected to the port holes. The gas pushes directly against an end surface of the bottom connector 20 that abuts the port holes (the end surface 21 of the bottom connector 20 that is adjacent to the port holes 44 in the embodiment of FIGS. 1, 3 and 5, and a corresponding enclosing surface across the top end of the bottom connector 20 adjacent to the single port hole 70 in the embodiment of FIG. 4). The gas pressure causes the bottom connector 20, together with the attached cylinder 10 and top cap 30, to move downward relative to the piston rod 40 while the piston rod 40 stays in place, expanding the setting tool into the stroked configuration.

The bottom connector 20 has a top end that is connected to the cylinder 10. The bottom connector 20 has an inner surface that is sealed around the piston rod 40. O-rings within O-ring slots, for example, can help form the seal 62 between the inner surface of the bottom connector 20 and the outer surface of the piston rod 40. The bottom connector's seal 62 around the piston rod 40 allows the bottom connector 20 to move relative to the piston rod 40 by sliding. The bottom connector 20 has a bottom end configured to connect a setting sleeve to the setting tool, where the setting sleeve is coupled to a plug, a packer, or the like.

A setting tool in accordance with an embodiment is intended to be used with electric wireline service.

A prior art setting tool cannot be attached using a shear ring. Because shear ring attachment causes a setting tool to be disposable and reuse is not typically possible, using a shear ring is not feasible for most prior art setting tools. Moreover, for some setting tools, geometry prohibits shear ring accommodation because they are not designed to allow shear ring placement.

For some embodiments, the cylinder 10 can be made from tubing. This feature is unique because design constraints and geometry make the use of tubing impossible for prior art setting tools, for which neither the tubing itself nor its connections will satisfy design requirements and safety factors.

For some embodiments, the piston rod 40 is machined from a single piece of bar stock as shown in FIGS. 1, 3 and 5. The piston rod 40 includes an upper section within which the power charge chamber 45 is formed, a transition section including flow paths 46 to the port holes 44 and the lower shoulder 47 against which an end surface 21 of the bottom connector 20 abuts when the setting tool is in the unstroked configuration, and a lower section providing an attachment point for a setting adapter. For other embodiments, such as the modular embodiment shown in FIG. 4, the piston rod 40 includes a discrete upper section 41, a discrete piston section 42, and a discrete lower section 43. The upper section 41 is made from tubing and has a bottom connection. The piston section 42 has a top connection and a bottom connection. The lower section 43 is also made from tubing and has a top connection for securing the lower section 43 to the piston section 42. The bottom connection on the modular piston rod's upper section 41 connects to the top connection on the piston section 42, and the bottom connection on the piston section 42 connects to the top connection on the piston rod's lower section 43. Prior art setting tools cannot have multi-part piston rods made partially from tubing because of design requirements and geometry. Use of tubing reduces material use and machining time to give an embodiment advantages over prior art setting tools in terms of production time and cost. Embodiments have significant geometrical differences from prior art tools and obtain movement differently. Embodiments provide safety factors that prevent possible failures and disperse gases that actuate the tools differently.

The outer tool assembly (OTA) comprises the top cap 30, barrel (cylinder) 10, and bottom connector 20. During deployment, the shear ring 50 keeps the tool in place until it reaches its target location in the well bore. Then the wireline sends current to the tool, which energizes the igniter to shoot a flame that lights the power charge generating expanding gas in the power charge chamber 45. The pressurized gas escapes the power charge chamber 45 through the gas ports (flow ports 46 and port holes 44 in the embodiments of FIGS. 1, 3 and 5) and acts directly on a surface of the bottom connector 20 (end surface 21 in the embodiments of FIGS. 1, 3 and 5) adjacent the end of the gas ports, forcing the bottom connector 20 downward relative to the piston rod 40 and pulling the cylinder 10 and top cap 30 downward. This causes the OTA to break the shear ring 50 and begin moving down the mandrel.

The movement continues setting the plug into the well bore. Plugs with shear values from 28,000 pounds (lbs) to 55,000 lbs attach to the tool by way of a wireline adapter kit (WAK). Once the shear value of the plug has been reached, the WAK will shear loose from the plug. The OTA continues moving relative to the mandrel until, as shown in FIG. 3, the cylinder's bleed off port 51 passes the seal 60 below the power charge chamber 45 and the seal 62 on the interior of the bottom connector 20 reach the seal relief feature 52 near the bottom of the piston rod 40. Gas pressure can then escape from the setting tool into the well bore. The stroke of the setting tool will stop when the top cap 30 moves far enough down to reach upper shoulders 48 projecting from the piston section of the piston rod 40 (the region between shoulders 48 and 47 in the embodiments of FIGS. 1, 3 and 5 or the piston section 42 in the embodiment of FIG. 4).

Figure 6:
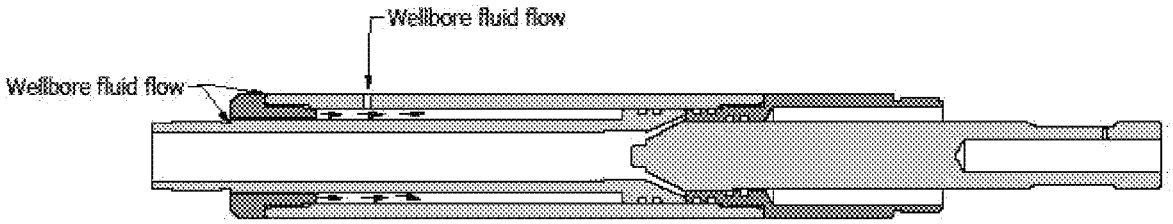
FIG. 6 shows a cross section of a gas operated setting tool in the unstroked position with arrows indicating well bore fluid flow paths as the tool is lowered into well bore in accordance with an embodiment of the present disclosure.
Figure 7:
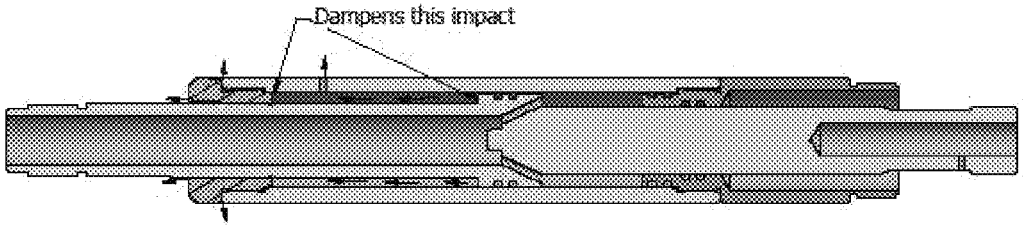
FIG. 7 shows a cross section of a gas operated setting tool during the stroke with arrows indicating well bore fluid flow paths as the tool strokes in accordance with an embodiment of the present disclosure.

As shown in FIGS. 1, 3 and 5, no seal(s) are provided between the top cap 30 and the upper portion of the mandrel 40. As shown in FIG. 6, while the setting tool is being lowered into position, fluid within the well bore can pass through the space 12 between the top cap 30 and the mandrel 40, and through the bleed-off port 51, filling the space 15 between the cylinder 10 and the mandrel 40 and between top cap 30 and the projecting shoulder 48 or piston section 42. As shown in FIG. 7, the fluid within space 15 acts to dampen movement of the OTA, and especially the impact of the top cap 30 against the upper projecting shoulder 48 or piston section 42.

Some embodiments of a gas operated setting tool, such as those of FIGS. 1, 3 and 5, are assembled from four major machined parts: a top cap 30, a mandrel (piston rod) 40, a barrel (cylinder) 10, and a bottom connector 20. The mandrel 40 has a top section that fits into the top cap's hollow interior and interfaces with the top cap 30 with a circumferential shear ledge preventing the tool from actuating during the deployment phase of the down hole trip. There is a bored hole in one end of the mandrel forming the power charge chamber 45 configured to receive an explosive power charge such as, for example, a commercially-available "Go style" energetic. At the bottom of the power charge chamber 45, there are flow paths leading to two small holes that serve as gas ports 44 drilled linearly through the middle (piston) section of mandrel (the portion that functions as the piston, between the upper projecting shoulder 48 and the shoulders 47 having the port holes 44). The barrel 10 is a tubular body open on both ends. The bottom connector 20 is open on both ends but contains a sealed section on one end and threads into barrel 10. The mandrel 40 is placed through the barrel 10 and the bottom connector 20, with the middle piston section of the mandrel in direct mechanical contact with the end surface 21 of the bottom connector 20. Specifically, the mandrel's lower section is inserted from above into the barrel 10 and through the bottom connector's opening until the mandrel's piston section contacts the bottom connector 20. The top cap 30 has two open ends and is placed over the top section of the mandrel 40 and threaded into the barrel 10, securing the tool together and forming the uniform circumference shear ledge between the mandrel 40 and the top cap 30 for the prevention of inadvertent stroking of the tool during deployment. The lower end 46 of the mandrel 40 and the lower end 23 of the bottom connector 20 form a "Baker Style" connection for connecting a zone isolation plug or packer.

In an embodiment, a barrel 10 and a bottom connector 20 are separate machined parts that screw together forming a lower piston. This serves two purposes. First, it makes machining the part less expensive. Second, it provides direct contact of the pressurized gas with the piston rod's piston section, producing more prompt movement of the tool when contact with the pressurized gas is introduced. This means that the cylinder 10 sees less pressure for a shorter duration because the tool is already stroking before the cylinder 10 experiences pressure. In contrast, prior art setting tools must pressurize analogous components significantly before stroking can begin. An embodiment's barrel 10 and bottom connector 20 have direct contact with the mandrel piston and gas vents pass through the mandrel piston coming to the top of the bottom connector's lower piston. Once the gas is introduced the lower portion the OTA immediately begin a downward movement to begin the setting process of the plug or packer. This enables the gas to act in a direct manner to actuate the tool for setting the plug or packer.

In an embodiment, the shear ring 50 prevents movement (anti-preset) of the OTA until the power charge has fired. Prior art setting tools use a screw that penetrates radially to prevent premature movement. A matching circular ledge is machined onto both the top cap 30 and the mandrel 40 to avoid the possibility of damage to the "anti-preset" system during the hook up process of the plug or packer or the hook up to the gun string since rotation of the tool will not damage a circumferential shear ring 50. For safety, it is important for the setting tool to come to the surface without any of the gas that operated the tool remaining inside it. Embodiments have a double pressure relief machined onto the lower portion of the mandrel. An embodiment can use a gas generating power charge that is standard to the industry. An embodiment can accommodate a firing head that attaches to mandrel and then to a gun string that is common to the industry. Unlike prior art setting tools, an embodiment can simultaneously use a "Go Style" gas generating power charge and a "Baker Style" lower end hook up connection.

FIG. 5 illustrates another embodiment that includes features such as those disclosed above, and which can be modified to include some or all of the features discussed above and can be operated as described above. The embodiment illustrated in FIG. 5 includes a mandrel (piston rod) 40. The OTA of the setting tool in FIG. 5 includes a top cap 30, the cylinder 10, and a bottom connector 20. Cylinder 10 includes bleed-off port 51. A shear ring is formed between the mandrel 40 and top cap 30 as described above.

FIG. 5 illustrates O-ring slots forming the seal 60, within which slots O-rings are placed to seal the interface between the exterior surface of mandrel 40 and the interior surface of cylinder 10. Similarly, O-ring slots forming the seals 61 and 62 are illustrated in bottom connector 20, in which O-rings are placed to seal the interface between the bottom connector 20 and the interior surface of cylinder 10 and between the bottom connector 20 and the exterior surface of the mandrel 40. O-rings help form the seal 62 of the interface between the bottom connector 20 and the exterior surface of mandrel 40 until the cylinder 10 and bottom connector 20 stroke over the mandrel 40 to a point where (a) the O-ring slots (and corresponding O-rings) are over the seal relief feature 52 near the bottom of the mandrel 40, and (b) the bleed-off port 51 has moved below O-ring slots and corresponding O-rings forming the seal 60, at which point the pressurized gas can escape from the setting tool into the well bore. As illustrated in FIGS. 1, 3 and 5, the seal relief feature 52 can include an indentation in the outer circumference of the mandrel 40 and, as illustrated in FIG. 5, the seal relief feature 52 can further include a vent hole to the interior of the mandrel 40.

In the example of FIGS. 1, 3 and 5, the bottom of power charge chamber 45 opens directly to gas ports 44, which extend from the bottom end of power charge chamber 45 directly onto the end surface 21 of the bottom connector 20. In the example of FIG. 5, the bottom end of power charge chamber 45 splits into a "Y" shape, with the center portion of the bottom of power charge chamber 45 including a protrusion 80 extending into power charge chamber 45 to cause the pressurized gasses in power charge chamber 45 to more efficiently flow to the port holes 44. The protrusion 80 acts as a standoff to support the power charge, keeping the power charge from plugging the flow ports 46. The "shelves" illustrated around the protrusion 80 in FIG. 5 are not required, but may result from the machining processes used to create the flow ports 46 to the port holes 44. The flow ports 46, as described herein, terminate directly against an end surface 21 of bottom connector 20, so that gasses passing through port holes 44 act directly on bottom connector 20 without energy or gas wasted on filling any extraneous volume between port holes 44 and the surfaces of the bottom connector 20.

What is claimed:

1. A gas operated setting tool, comprising:

a mandrel; and an outer tool assembly, wherein the outer tool assembly has a hollow interior and the mandrel is disposed coaxially within the hollow interior of the outer tool assembly, wherein the outer tool assembly comprises:

a top cap having an interior surface, a cylinder having an upper end, a lower end, and an interior surface, and a bottom connecter having an upper surface and an interior surface, wherein the top cap connects to the upper end of the cylinder and the bottom connector connects to the lower end of the cylinder, wherein the mandrel comprises an upper section having an exterior surface, a piston section having an exterior surface, and a lower section having an exterior surface, wherein the upper section of the mandrel comprises a firing head attachment and the lower section of the mandrel is configured to connect to a setting adapter, wherein the exterior surface of the piston section fits within the interior surface of the cylinder and the exterior surface of the piston section and the interior surface of the cylinder are sealed, wherein the upper section of the mandrel has a hollow power charge chamber configured to receive a power charge and the piston section has one or more gas ports that each extend from a bottom of the power charge chamber and open directly onto a surface of the bottom connector.

2. The gas operated setting tool of claim 1, further comprising:

a shear ring between the exterior surface of the upper section of the mandrel and the interior surface of the top cap, the shear ring configured to prevent axial movement of the outer tool assembly relative to the mandrel until the power charge has fired and sheared the shear ring.

3. The gas operated setting tool of claim 2, wherein the shear ring is formed on an exterior surface of the mandrel and the interior surface of the top cap comprises a surface feature that engages the shear ring.

4. The gas operated setting tool of claim 1, wherein the bottom connector has a bottom end configured to connect to a setting sleeve.

5. The gas operated setting tool of claim 1, wherein the cylinder is made from tubing.

6. The gas operated setting tool of claim 1, wherein the mandrel is machined from a single piece of bar stock.

7. The gas operated setting tool of claim 1, wherein the exterior surface of the lower section of the mandrel is sealed with the interior surface of the bottom connector when the gas operated setting tool is in an unstroked position.

8. The gas operated setting tool of claim 7, wherein the lower section of the mandrel comprises a secondary relief that allows gas to escape from the setting tool after the outer tool assembly has moved axially relative to the mandrel to a stroked position where the exterior surface of the lower section of the mandrel is no longer sealed with the interior surface of the bottom connector.

9. The gas operated setting tool of claim 1, further comprising:

a primary bleed that penetrates the cylinder radially and allows gas to escape from the setting tool after the outer tool assembly has moved axially relative to the mandrel so that the primary bleed is below a seal between the exterior surface of the piston section of the mandrel and the interior surface of the cylinder.

10. A gas operated setting tool, comprising:

a piston rod; and an outer tool assembly, wherein the outer tool assembly has a hollow interior and the piston rod is disposed coaxially within the hollow interior of the outer tool assembly, wherein the outer tool assembly comprises:

a top cap having an interior surface, a cylinder having an upper end, a lower end, and an interior surface, and a bottom connecter having an upper surface and an interior surface, wherein the top cap connects to the upper end of the cylinder and the bottom connector connects to the lower end of the cylinder, wherein the piston rod comprises an upper section having an exterior surface, a piston section having an exterior surface, and a lower section having an exterior surface, wherein the upper section of the piston rod comprises a firing head attachment and the lower section of the piston rod is configured to connect to a setting adapter, wherein the exterior surface of the piston section fits within interior surface of the cylinder and a seal is formed between the exterior surface of the piston rod and the interior surface of the cylinder, wherein the upper section of the piston rod has a hollow power charge chamber configured to receive a power charge and the piston section has a plurality of flow ports that each open into a bottom of the power charge chamber at one end and that open onto a portion of the upper surface of the bottom connector at another end.

11. A gas operated setting tool of claim 10, further comprising:

a shear ring on the interior surface of the top cap, the shear ring configured to prevent axial movement of the outer tool assembly relative to the piston rod until the power charge has fired and sheared the shear ring.

12. The gas operated setting tool of claim 11, wherein the exterior surface of the upper section of the piston comprises a surface feature that engages the shear ring.

13. The gas operated setting tool of claim 10, wherein a center portion of the bottom of the power charge chamber between the plurality of flow ports protrudes into the power charge chamber to increase flow efficiency of pressurized gas from the power charge chamber through the plurality of flow ports.

14. A gas operated setting tool, comprising:

a mandrel, wherein the mandrel comprises a plurality of individual pieces, wherein an upper section of the mandrel is made from tubing and has a bottom connection, wherein a piston section of the mandrel has a top connection and a bottom connection, wherein a lower section of the mandrel is made from tubing and has a top connection, and wherein the bottom connection on the upper section of the mandrel connects to the top connection of the piston section and the bottom connection of the piston section connects to the top connection on the lower section of the mandrel; and an outer tool assembly, wherein the outer tool assembly has a hollow interior and the mandrel is disposed coaxially within the hollow interior of the outer tool assembly, wherein the outer tool assembly comprises:

a top cap having an interior surface, a cylinder having an upper end, a lower end, and an interior surface, and a bottom connecter having an upper surface and an interior surface, wherein the top cap connects to the upper end of the cylinder and the bottom connector connects to the lower end of the cylinder, wherein the mandrel comprises an upper section having an exterior surface, a piston section having an exterior surface, and a lower section having an exterior surface, wherein the upper section of the mandrel comprises a firing head attachment and the lower section of the mandrel is configured to connect to a setting adapter, wherein the exterior surface of the piston section fits within the interior surface of the cylinder and the exterior surface of the piston section and the interior surface of the cylinder are sealed, wherein the upper section of the mandrel has a hollow power charge chamber configured to receive a power charge and the piston section has a gas port that extends from a bottom of the power charge chamber and opens directly onto an enclosing surface at the top end of the bottom connector.

* * * * *